US005806245A

United States Patent [19]

Satrom

[11] Patent Number: 5,806,245

[45] Date of Patent: Sep. 15, 1998

[54] VERTICAL LIFT GATE ASSEMBLY

[76] Inventor: James P. Satrom, 1527 Cottonwood St., Grand Forks, N. Dak. 58201

[21] Appl. No.: 586,236

[22] Filed: Jan. 16, 1996

[51] Int. Cl.[6] ..... E05F 11/00

[52] U.S. Cl. ..... 49/360

[58] Field of Search ..... 49/360, 361, 445, 49/447

[56] References Cited

U.S. PATENT DOCUMENTS

| | | | |
|---|---|---|---|
| 1,551,248 | 8/1925 | Gilmore | 49/360 X |
| 1,909,814 | 5/1933 | Davis | 49/360 X |
| 3,531,895 | 10/1970 | Appell | 49/360 |
| 3,755,967 | 9/1973 | Nourse | 49/360 |
| 4,091,439 | 5/1978 | Blair | 49/445 X |
| 5,072,544 | 12/1991 | Breck | 49/360 X |

*Primary Examiner*—Jerry Redman
*Attorney, Agent, or Firm*—David A. Lingbeck

[57] ABSTRACT

A vertical lift gate assembly includes a pair of elongate tubular members vertically erected and spaced apart from one another to accommodate a gate member therebetween, a pair of rail members securely fastened to the tubular members and adapted to receive and guide bearings which are attached to the sides of the gate member, and a pair of flexible lines connected to the gate member and carried by a pair of pulleys mounted to near the tops of the elongate tubular members. The gate member can be raised and lowered either manually which includes a counterweight member attached to the flexible lines and disposed in one of the tubular members; or pneumatically which includes a pneumatic cylinder which is the counterweight member and which receives compressed air from a compressed air source; or electrically which includes a speed reduced motor having a pulley attached to the shaft of the motor and connected to the flexible lines of which are either taken up or let out by the pulley on the motor. The gate member can be raised pass the pulleys on the tubular member all the way to the ceiling in a building structure.

6 Claims, 7 Drawing Sheets

VERTICAL LIFT GATE ASSEMBLY

BACKGROUND OF THE INVENTION

The present invention relates to a vertical lift gate assembly which is commonly used as a front on mezzanines or even storage racks to essentially guard against items placed thereon or people from falling off and possibly injuring people beneath the mezzanines or storage racks.

Such gates have also been commonly used for years to block access to freight elevators particularly in warehouses. Most elevators have sliding doors, but because freight elevators have a much larger access opening so that large pieces of cargo which would not be capable of being loaded on passenger elevators having sliding doors can be put on freight elevators, vertical lift gates rather sliding doors are used on the freight elevators and to block access to the freight elevators, in particular, to the freight elevator shafts. These vertical lift gates commonly have a gate member, a pair of rails vertically and securely disposed and spaced apart from one another, a plurality of guide bearings attached to the sides of the gate member and movably disposed on the rails, flexible lines such as straps connected to the gate member and to a counterweight member for aiding in the lifting of the gate member.

One known prior art is a VERTICAL LIFT GATE, U.S. Pat. No. 3,394,497, issued on Jul. 30, 1968 and invented by J. S. Case, which comprises a pair of tower posts, a gate member, rollers attached to the gate member and bearing against the tower posts, pulleys, and cables carried by the pulleys for lifting the gate member.

Another known prior art is a SAFETY MEZZANINE GATE, U.S. Pat. No. 4,538,379, issued on Sept. 3, 1985 and invented by William R. Vargo, which comprises a U-shaped gate member mounted on a horizontal axis and pivotally movable between a first position wherein a barrier portion of the gate member traverses an opening in the guard railing and a second position wherein the barrier portion is removed from the opening.

The prior art does not describe nor suggest a vertical lift gate assembly in which the gate member can be moved upward right to the ceiling of a building in which the vertical lift gate is being used, because the pulleys in the prior art are right in the way which prevents the gate member from being moved upward right to the ceiling.

SUMMARY OF THE INVENTION

This invention relates to a vertical lift gate assembly comprising a gate member, a pair of elongate tubular members extending from the floor to the ceiling in a building for supporting the gate member which is capable of moving up and down relative to the elongate tubular members each of which has a track member extending along the length of the respective tubular member and adapted to guide the gate member which is lifted by a pair of flexible lines which are carried by a pair of pulleys that are attached to near the tops of the tubular elongate members and which are connected to a counterweight member which moves up and down inside one of the elongate tubular members and which aids in helping to lift the gate member and also aids in providing constant tension on the flexible lines so that should the gate member come into contact with an obstruction as it is being lowered, the counterweight member substantially lessens the effects of the gate member on the obstruction by countering the weight of the gate member so that the obstruction does not encounter the full weight of the gate member.

Alternately, the counterweight member comprises a pneumatic cylinder which can be filled with compressed air from an outside compressed air supply which is connected to valves which are opened and closed by a switch means and which are further connected with hoses to the pneumatic cylinder which raises the gate member once it is filled with compressed air. Further, instead of using a counterweight means to lift the gate, a forward/reverse electric motor with speed reduction can be mounted on a crosspiece which interconnects the two elongate tubular members near the top ends thereof. The electric motor has a pulley which carries a pair of flexible lines each of which is carried about the respective pulley attached to an elongate tubular member and is connected to the gate member. An open and close switch means energizes the electric motor either to take up the flexible lines about the pulley on the shaft of the electric motor which raises the gate member or to let out the flexible lines from about the pulley on the shaft which lowers the gate member.

One objective of the present invention is to provide a vertical lift gate assembly which is capable of raising the gate member right to the ceiling of a building in which the vertical lift gate assembly is being used.

Another objective of the present invention is to provide a vertical lift gate assembly which can be cloned side by side by using a common elongate tubular member.

Also, another objective of the present invention is to provide a vertical lift gate assembly which can be easily opened and closed either by manual labor, by compressed air, or by other automation means.

Further objectives and advantages of the present invention will become apparent as the description proceeds and when taken in conjunction with the accompanying drawings wherein:

DETAILED DESCRIPTION OF THE INVENTION

Figure 1:
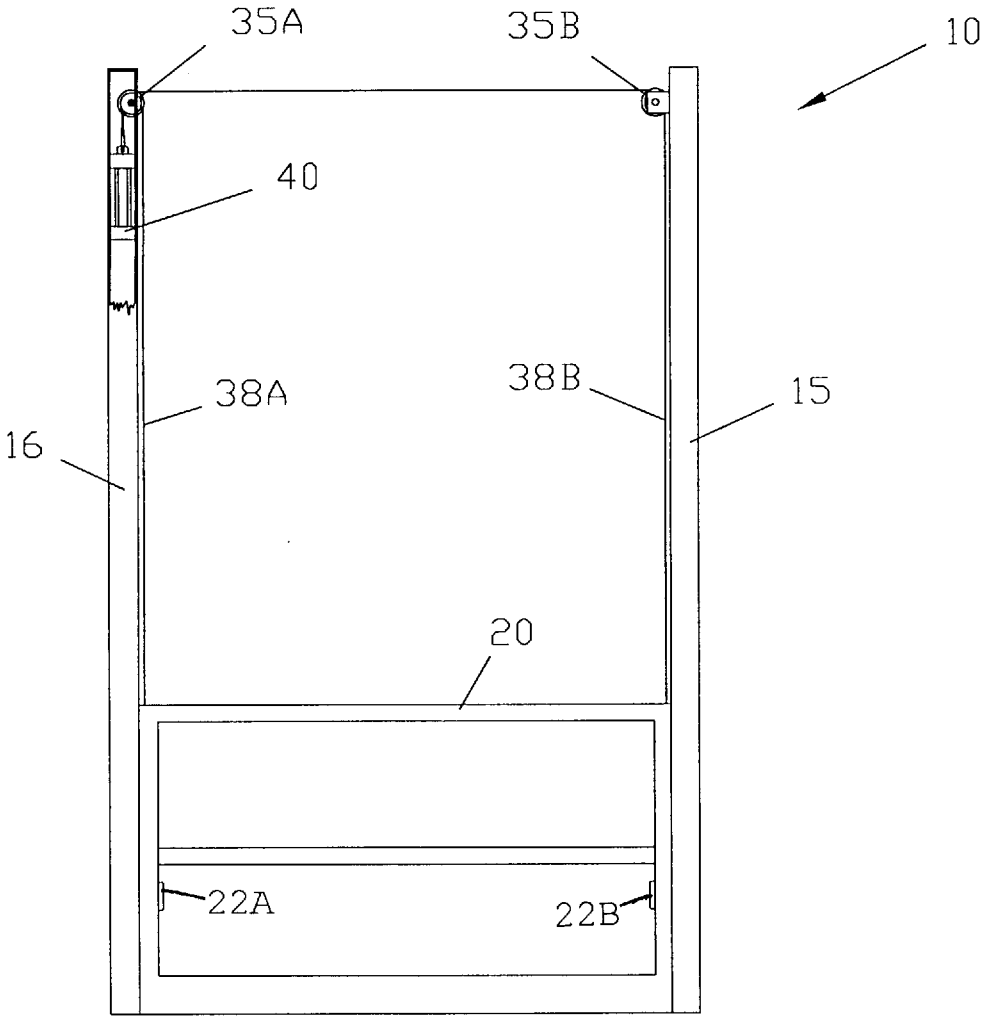
FIG. 1 is a front elevation view of the vertical lift gate assembly.

Referring to the drawings in FIGS. 1–7, in particular, the vertical lift gate assembly 10 comprises a gate member 20 and a pair of elongate tubular members 15, 16 vertically and securely erected and spaced apart from one another so as to accommodate the gate member 20 therebetween, the gate member having a plurality of guide bearings 21A–B mounted to the sides thereof for vertical movement.

Figure 2:
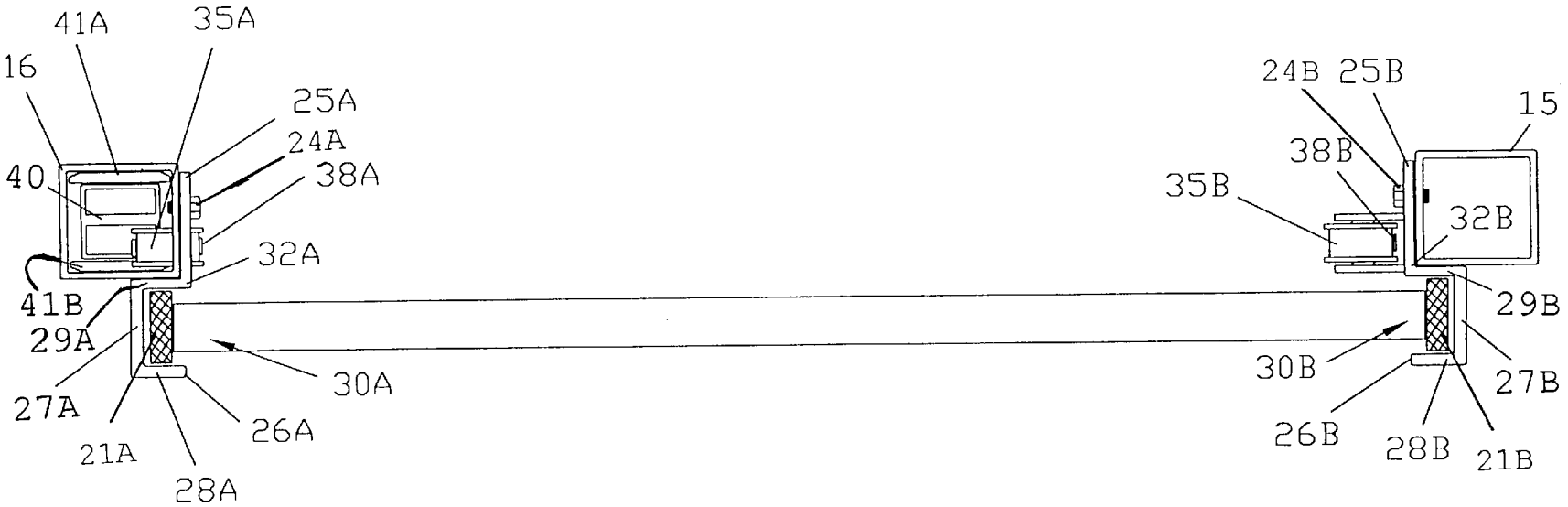
FIG. 2 is a top plan view of the vertical lift gate assembly.
Figure 3:
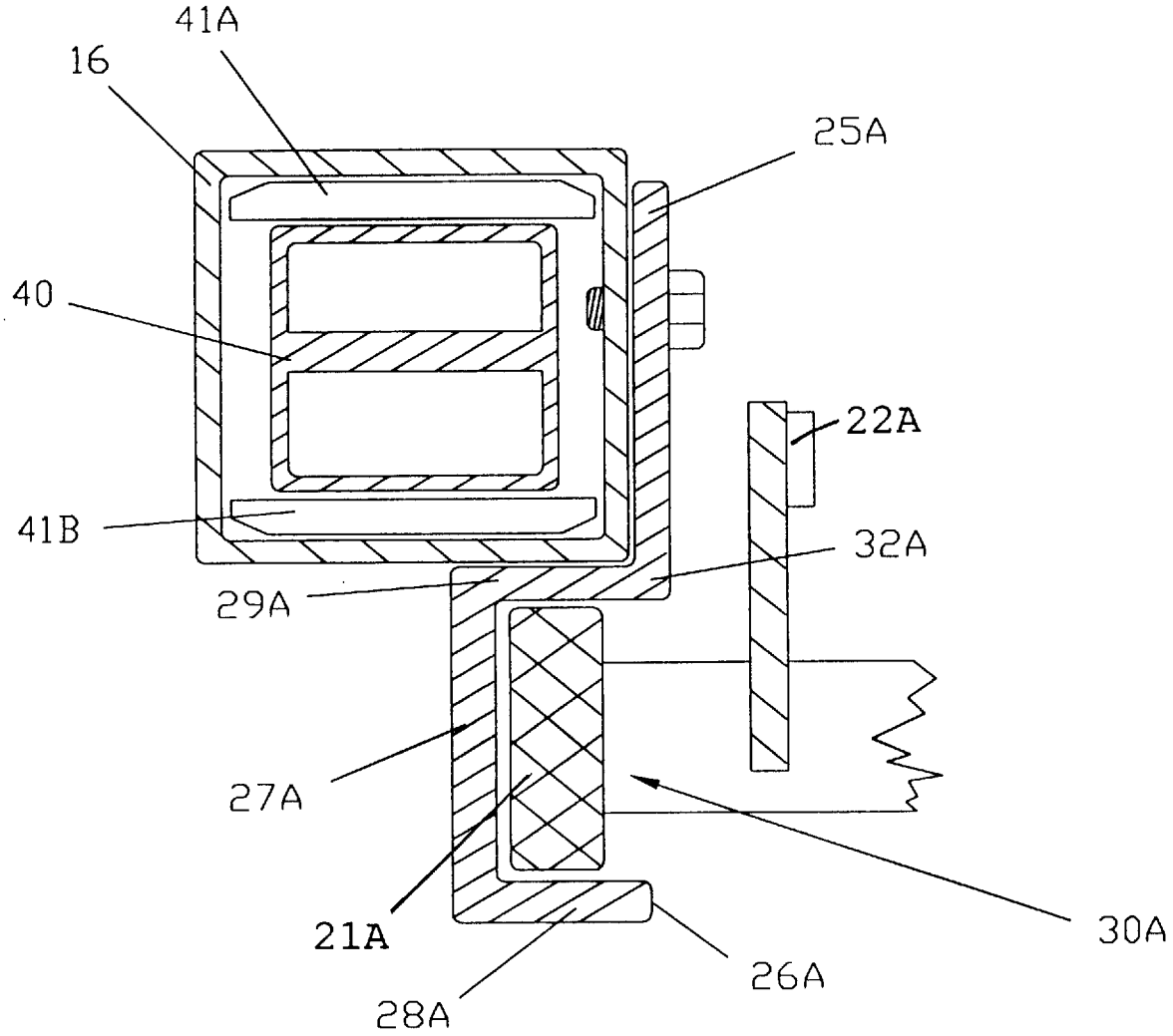
FIG. 3 is a top detail view of the counterweight member inside one of the elongate tubular members of the vertical lift gate assembly.
Figure 6:
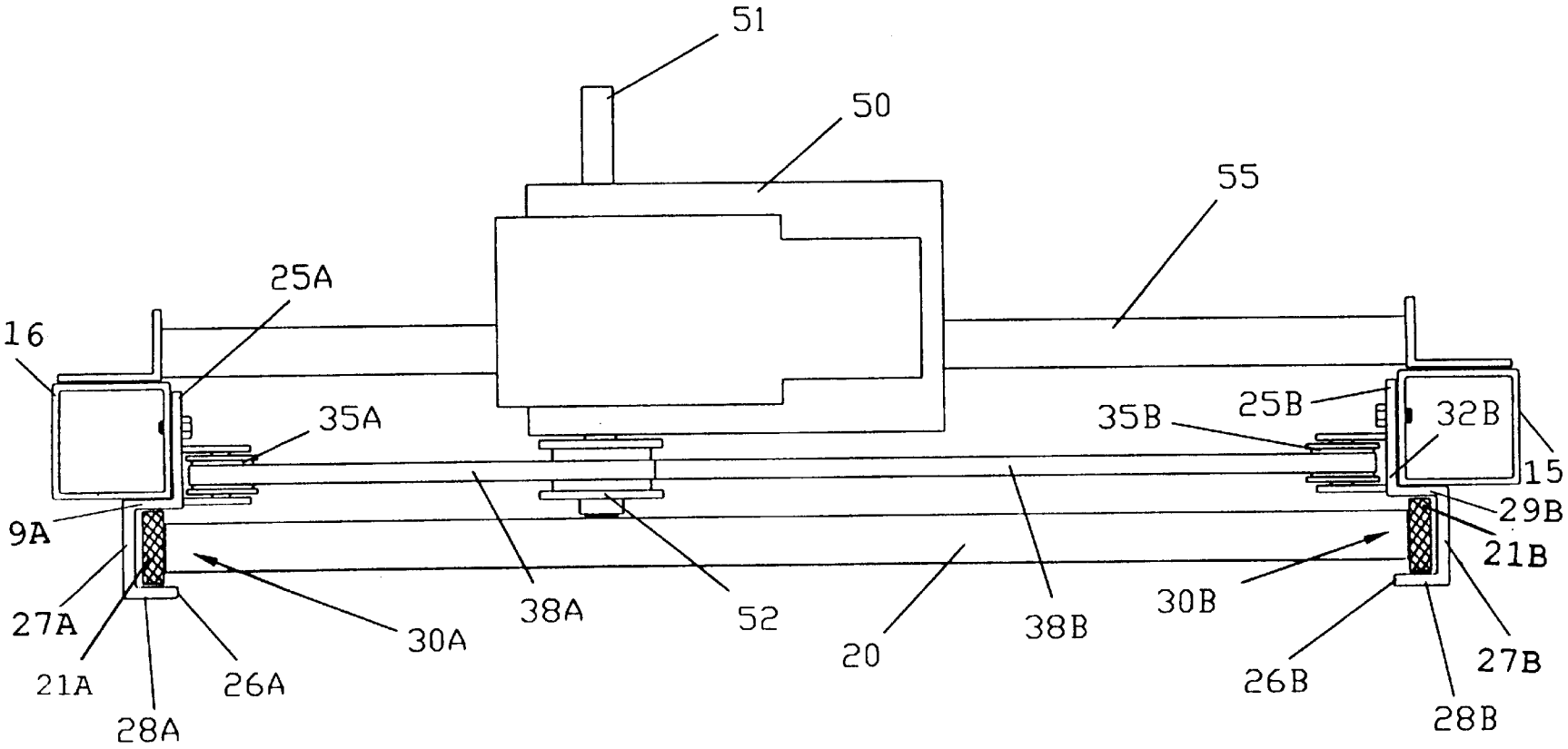
FIG. 6 is a top plan view of the vertical lift gate assembly which is operated by electrical means.

As shown in FIGS. 2, 3 & 6. a pair of rail members 25A–B are fastened with screws 24A–B to the elongate tubular members 15, 16; wherein each of the rail members 25A–B extend along the length of a respective one of the elongate tubular members 15, 16. Each rail member 25A–B has an angular lateral cross-section such that, as viewed from the top of one elongate tubular member 15 and facing the opposing elongate tubular member 16, each rail member 25A–B has a generally U-shaped channel portion 26A–B having a closed end 27A–B, an open end 30A–B, and a pair of side walls 28A–B, 29A–B, and further has a flange 32A–B which is integrally attached to one of the side walls 29A–B at the open end 30A–B with the flange 32A–B extending outward and perpendicular to the side wall 29A–B. The flange 32A–B is fastened to the side of the elongate tubular member 15, 16 facing the opposing elongate tubular member 15, 16 such that the open end 30A–B of the channel portion 26A–B faces and is generally aligned with the open end 30A–B of the opposing channel portion 26A–B of the other rail member 25A–B. The channel portion 26A–B is disposed either to the front or back of the respective elongate tubular member 15, 16.

As shown in FIGS. 2, 3 & 6, the guide bearings 21A–B on the gate member 20 are movably received in and guided by the channel portions 26A–B of the rail members 25A–B such that the guide bearings 21A–B move vertically within the channel portions 26A–B. The gate member 20 is lifted vertically by a pair of flexible lines 38A–B such as cables which are connected to the gate member 20 and which are carried by a pair of conventional pulleys 35A–B each of which is mounted to near the top end of a respective one of the elongate tubular members 15, 16. Each of the pulleys 35A–B is mounted to the side of its respective elongate tubular member 15, 16, the side facing the opposing elongate tubular member 15, 16 such that it is out of the way of the gate member 20 and does not hinder the lifting of the gate member 20. The flexible lines 38A–B extend through an opening in the side of one of the elongate tubular members 16 and are attached to a counterweight member 40 which is movably disposed inside that elongate tubular member 16. A pair of guide bearings 41A–B which have preferably a quadrilateral shape and are made of specific plastic requiring no lubrication, are mounted to two of the sides of the counterweight member 40 and are slidably engageable on the interior of the elongate tubular member 16 so as to substantially lessen the possibility of the counterweight member 40 getting hung up inside the elongate tubular member 16 and also to facilitate the vertical movement of the counterweight member 40 inside the tubular member 16. The counterweight member 40 helps the user to easily lift the gate member 20 without much effort and helps to retain tension on the flexible lines 30A–B.

The gate member 20 can be raised right up to the ceiling of the building structure in which the vertical lift gate assembly 10 is used to give the user greater clearance between the floor and the gate member 20. The elongate tubular members 15, 16 are adapted to extend from the floor all the way to the ceiling. Brackets (not shown) are attached to the top ends of the tubular elongate members 15, 16 and are fastened to the ceiling to secure the tubular members 15, 16. Since the channel portions 26A–B of the rail members 25A–B are either to the front or back of the tubular members 15, 16, the gate member 20 does not come into contact with the pulleys 35A–B. Near the sides of the gate member 20 are a pair of adjustable brackets 22A–B which are fastened to the facing of the gate member 20 either on the back or front thereof and which extend perpendicular to the gate member 20 and which are connected to the pair of flexible lines 38A–B. The brackets 22A–B are spaced from the sides of the gate member 20 such that they will clear the pulleys 35A–B as the gate member 20 is lifted pass the pulleys 35A–B.

Figure 4:
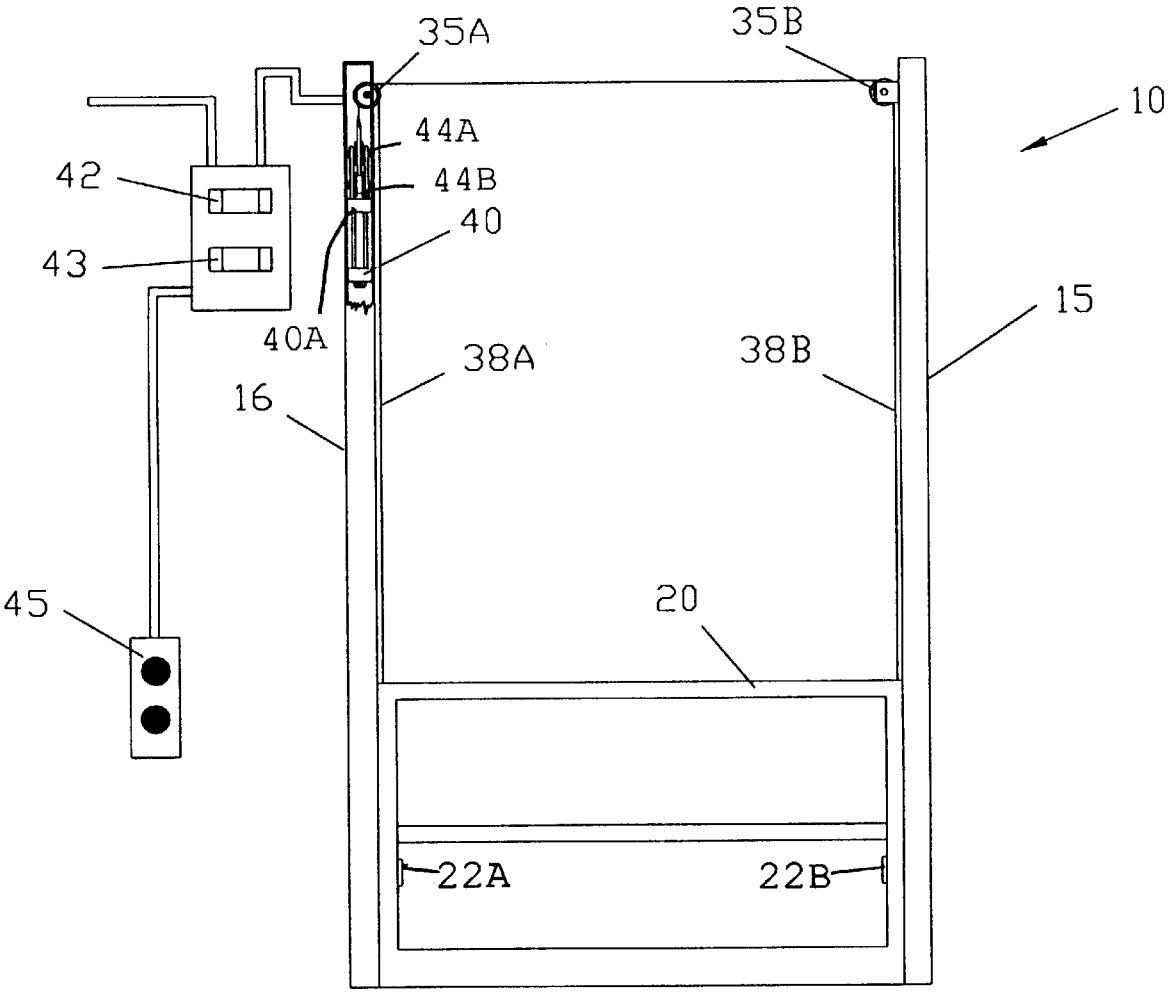
FIG. 4 is a front elevation view of the vertical lift gate assembly which is operated by compressed air.
Figure 5:
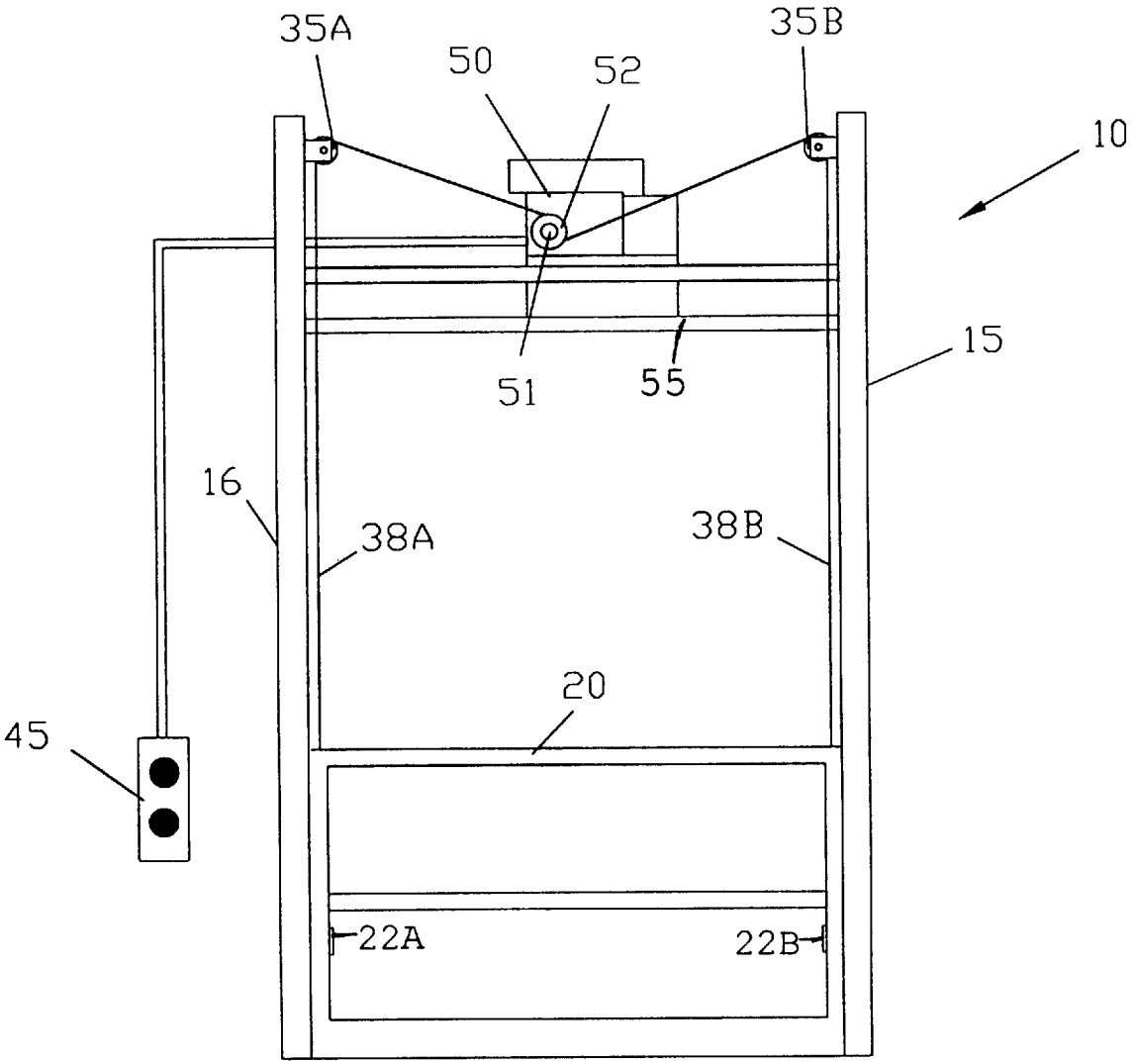
FIG. 5 is a front elevation view of the vertical lift gate assembly which is operated by electrical means.

Optionally, as shown in FIG. 4, the gate member 20 can be lifted and operated by pneumatic means which comprises the counterweight member 40 which is a pneumatic cylinder 40A connected to a hose and adapted to receive compressed air from a compressed air source such as an air compressor and is further supported by a pair of pulleys 44A–B which carries the flexible lines 38A–B in such a way that the gate member 20 moves twice the distance of the pneumatic cylinder 40A. As the pneumatic cylinder 40A fills with air, pressure builds within the cylinder 40A thus overcoming the weight of the gate member 20, thus effecting the raising of the gate member 20. The more air put into the cylinder 40A, the more pressure that builds up in the cylinder 40A and the higher the gate member 20 will be raised. The pneumatic means further includes a fill valve 42 which is disposed in line between the compressed air source and the counterweight member 40 to control the filling of the pneumatic cylinder 40A with the compressed air and also includes a release valve 43 which releases the compressed air from the pneumatic cylinder 40A to allow the gate member 20 to lower or to close. The valves 42, 43 are energized by an open and close switch means 45. The user can raise or lift the gate member 20 by continually or momentarily depressing the open button on the switch means 45 which opens the fill valve 42 to allow the compressed air to enter the pneumatic cylinder 40A. Depending upon how high the user wants to raise the gate member 20, the user will release the open button which closes the fill valve 42 which shuts off the compressed air to the pneumatic cylinder 40A.

If the user wants to lower or close the gate member 20, the user will depress the close button on the switch means 45 which opens the release valve 43 to let out the compressed air in the pneumatic cylinder 40A which reduces the pressure in the counterweight member 40 causing the gate member 20 to lower or to close. Once the gate member 20 has lowered or closed as determined by the user, the user will release the close button on the switch means 45.

Figure 7:
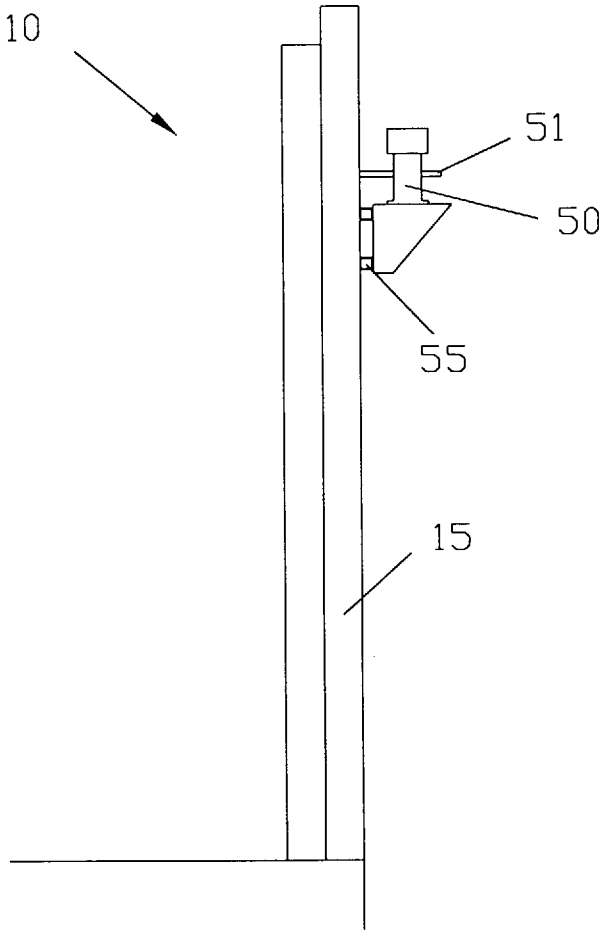
FIG. 7 is a side elevation view of the vertical lift gate assembly which is operated by electrical means.

As another alternative as shown in FIGS. 6 & 7, the vertical lift gate assembly 10 can be operated by electrical means. Instead of using the counterweight member 40 to control the lifting and lowering of the gate member 20, an electrical motor 50 is used to raise and lower the gate member 20. The motor 50 is mounted upon a crosspiece 55 which interconnects the two elongate tubular members 15, 16 near the tops thereof. The motor 50 is a speed reduction motor and has a shaft 51 which has a pulley 52 attached thereto. The pulley 52 on the motor 50 is generally in alignment with and spaced between the two pulleys 35A–B on the two elongate tubular members 15, 16. The flexible lines 38A–B carried by the two pulleys 35A–B on the tubular members 15, 16 are attached to the pulley 52 on the motor 50 and also has a tension sensor (not shown) which is connected to the switch means and which sends a signal or pulse to the switch means 45 to stop the motor 50 if the flexible lines 38A–B becomes slackened for any reason. The open and close switch means 45 energizes the motor 50 to either open or close the gate member 20. If the user depresses the open button on the switch means 45, the motor 50 is actuated and the pulley 52 on the shaft 51 rotates in a first direction to take up both flexible lines 38A–B which causes the gate member 20 to rise.

To lower the gate member 20, the user depresses the close button on the switch means 45 which actuates the motor 50 such that the shaft 51 and pulley 52 rotate in a direction opposite to the first direction to let out the flexible lines 38A–B thus causing the gate member 20 to lower. Depending upon how high or low the user desires to position the gate member 20, the user will release the buttons on the switch means 45 which stops the motor 50 and also stops the gate member 20. As with the other two vertical lift gate operations, the gate member 20 can be lifted pass the motor 50 and right up to the ceiling. The crosspiece 55 is fixedly attached to the sides of the elongate tubular members 15, 16 not to the rail members 25A–B upon which the gate member 20 moves, and the motor 50 is either mounted ahead of or behind the gate member 20.

Because the gate member 20 moves up and down upon the rail members 25A–B rather than upon the tubular members 15, 16, one vertical lift gate assembly 10 can be disposed side-by-side to another vertical lift gate assembly; wherein, the two vertical lift gate assemblies will have a common elongate tubular member 15, 16. In fact, a plurality of vertical lift gate assemblies 10 can be arranged side-by-side for any distance desired by the user.

Various changes and departures may be made to the invention without departing from the spirit and scope thereof. Accordingly, it is not intended that the invention be limited to that specifically described in the specification or as illustrated in the drawings but only as set forth in the claims.

What is claimed is:

1. A vertical lift gate assembly comprising:

a pair of elongate tubular members vertically erected and spaced apart from one another; the pair of rail members each of which extends along length of and is securely fastened to a respective one of said elongate tubular members;

a gate member disposed between said elongate tubular members and movably mounted upon said rail members; and a means for raising and lowering said gate member which includes a pair of pulleys each of which is mounted to a respective one of said elongate tubular members and a pair of flexible lines carried by said pulleys for raising and lowering said gate member, said means for raising and lowering said gate member also including a counterweight member vertically movable inside one of said elongate tubular members and connected to said flexible lines to aid the lifting of said gate member and to provide tension to said flexible lines, a pair of guide bearing members being mounted to opposite sides of said counterweight member to facilitate vertical movement of said counterweight member inside one of said elongate tubular members.

2. A vertical lift gate assembly comprising:

a pair of elongate tubular members vertically erected and spaced apart from one another; the pair of rail members each of which extends along the length of and is securely fastened to a respective one of said elongate tubular members;

a gate member disposed between said elongate tubular members and movably mounted upon said rail members; and a means for raising and lowering said gate member which includes a pair of pulleys each of which is mounted to a respective one of said elongate tubular members and a pair of flexible lines carried by said pulleys for raising and lowering said gate member, said means for raising and lowering said gate member also including a counterweight member vertically movable inside one of said elongate tubular members and connected to said flexible lines to aid lifting of said gate member and to provide tension to said flexible lines, said counterweight member being a pneumatic cylinder which is adapted to receive compressed air thus effecting the lifting and lowering of said gate member, said pneumatic cylinder being supported by a pair of pulleys which carries said flexible lines in such a way that said gate member moves twice the distance of said pneumatic cylinder.

3. A vertical gate assembly as described in claim 2, wherein said means for raising and lowering said gate member also includes a plurality of valves connected to said pneumatic cylinder and to a compressed air supply for controlling flow of compressed air into and out of said pneumatic cylinder and a switch means for opening and closing said valves.

4. A vertical lift gate assembly comprising:

A pair of elongate tubular members vertically erected and spaced apart from one another;

the pair of rail members each of which extends along length of and is securely fastened to a respective one of said elongate tubular members;

a gate member disposed between said elongate tubular members and movably mounted upon said rail members; and a means for raising and lowering said gate member which includes a pair of pulleys each of which is mounted to a respective one of said elongate tubular members and a pair of flexible lines carried by said pulleys for raising and lowering said gate member, said means for raising and lowering said gate member comprising a speed reduced motor having a rotatable shaft, a pulley attached to said rotatable shaft for rotation therewith and having said flexible lines attached thereto, and a switch means to energize said motor which rotates said pulley on said shaft either to take up said flexible lines which lifts said gate member or to let out said flexible lines which lowers said gate member.

5. A vertical gate assembly as described in claim 4, wherein said means for raising and lowering said gate member further comprises a crosspiece interconnecting said elongate tubular members near tops thereof, said motor being mounted upon said crosspiece.

6. A vertical gate assembly as described in claim 5, wherein said motor is disposed between said elongate tubular members such that said gate member is not obstructed by said motor as it moves vertically and said gate member is capable of vertically moving pass said motor.

* * * * *